US006865357B2

(12) United States Patent
Fujita et al.

(10) Patent No.: US 6,865,357 B2
(45) Date of Patent: Mar. 8, 2005

(54) DRIVE TRANSMISSION MECHANISM FOR TRANSMITTING DRIVE TO PROCESSING MEANS AND CARTRIDGE PROVIDED WITH SAME

(75) Inventors: Akiyoshi Fujita, Shizuoka (JP); Kenji Matsuda, Shizuoka (JP); Nobuharu Hoshi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 53 days.

(21) Appl. No.: 10/321,426

(22) Filed: Dec. 18, 2002

(65) Prior Publication Data

US 2003/0133723 A1 Jul. 17, 2003

(30) Foreign Application Priority Data

Dec. 21, 2001 (JP) ..... 2001-388843

(51) Int. Cl.[7] ..... G03G 21/16
(52) U.S. Cl. ..... 399/111; 399/167
(58) Field of Search ..... 399/111, 167, 399/174, 175, 176, 313, 345, 350, 352, 353

(56) References Cited

U.S. PATENT DOCUMENTS

| | | | | | |
|---|---|---|---|---|---|
| 3,724,019 | A | * | 4/1973 | Shanly | 399/350 |
| 4,371,252 | A | * | 2/1983 | Uchida et al. | 399/175 |
| 4,451,139 | A | * | 5/1984 | Yanagawa et al. | 399/353 |
| 4,595,280 | A | * | 6/1986 | Tanzawa et al. | 399/345 |
| 5,528,341 | A | | 6/1996 | Shishido et al. | 355/200 |
| 5,630,199 | A | * | 5/1997 | To | 399/175 |
| 5,642,187 | A | | 6/1997 | Nomura et al. | 355/200 |
| 5,650,841 | A | | 7/1997 | Matsuda et al. | 399/111 |
| 5,678,139 | A | | 10/1997 | Nomura et al. | 355/200 |
| 5,697,022 | A | | 12/1997 | Matsuda et al. | 399/102 |
| 5,740,499 | A | | 4/1998 | Higeta et al. | 399/105 |
| 5,799,229 | A | * | 8/1998 | Yokoyama et al. | 399/176 |
| 5,809,374 | A | | 9/1998 | Tsuda et al. | 399/102 |
| 5,825,472 | A | | 10/1998 | Araki et al. | 355/200 |
| 5,963,759 | A | | 10/1999 | Kojima et al. | 399/111 |
| 6,016,408 | A | | 1/2000 | Hashimoto et al. | 399/27 |
| 6,078,763 | A | | 6/2000 | Hoshi | 399/111 |
| 6,101,352 | A | | 8/2000 | Hashimoto et al. | 399/119 |
| 6,151,459 | A | | 11/2000 | Hashimoto et al. | 399/27 |
| 6,321,051 | B1 | * | 11/2001 | Lee | 399/111 |
| 6,324,370 | B1 | | 11/2001 | Isobe et al. | 399/258 |
| 6,334,042 | B1 | * | 12/2001 | Quesnel | 399/353 |
| 6,421,512 | B2 | | 7/2002 | Watanabe et al. | 399/149 |
| 6,442,359 | B1 | | 8/2002 | Numagami et al. | 399/111 |
| 6,463,233 | B2 | | 10/2002 | Kojima et al. | 399/111 |

* cited by examiner

*Primary Examiner*—Hoan Tran
(74) *Attorney, Agent, or Firm*—Fitzpatrick, Cella, Harper & Scinto

(57) ABSTRACT

A drive transmission mechanism transmits a drive force to a processing unit that is in contact with an image bearing member to work on the image bearing member. The mechanism includes a supporting member that supports the processing unit. The supporting member is pivotally movable. The mechanism further includes a driving force receiving portion provided on the supporting member for receiving a driving force for reciprocating the processing unit in a longitudinal direction of the image bearing member, from a driving force imparting member, and a regulating member that regulates the pivotal movement of the supporting member.

46 Claims, 8 Drawing Sheets

DRIVE TRANSMISSION MECHANISM FOR TRANSMITTING DRIVE TO PROCESSING MEANS AND CARTRIDGE PROVIDED WITH SAME

BACKGROUND OF THE INVENTION

1. Field of the Invention

The present invention relates to a drive transmission mechanism for transmitting a drive force to processing means and a cartridge provided with such a mechanism, which are preferably used in an electrophotographic image forming apparatus, such as an electrophotographic copying machine or an electrophotographic printer.

In this connection, the electrophotographic apparatus is an apparatus for forming an image on a recording medium 52 by utilizing an electrophotographic-image-forming process.

The electrophotographic image forming apparatus includes, for example, an electrophotographic copying machine, an electrophotographic printer (e.g. an LED printer and a laser printer, etc.), an electrophotographic facsimile machine and an electrophotographic word processor etc.

What is referred to by the term "cartridge" is, for example, a cartridge formed as a unit including a photosensitive drum for electrophotography, serving as an image bearing member and at least one of charging means, developing means and cleaning means, which is adapted to be detachably attached to a body of an image forming apparatus.

2. Related Background Art

Conventionally, an image forming apparatus such as a copying machine, a printer, a facsimile machine etc., that utilizes an electrophotography system of a transferring type includes a photosensitive member serving as an image bearing member, generally in the form of a rotary drum, a charging apparatus (performing a charging process) for charging the photosensitive member uniformly with a prescribed polarity and up to a prescribed electric potential, an exposing apparatus (performing an exposing process) serving as information writing means for forming an electrostatic latent image on the photosensitive member that has been processed to be charged, a developing apparatus (performing a developing process) for visualizing the electrostatic latent image that has been formed on the photosensitive member with a developer in the form of a toner, a transferring apparatus (performing a transferring process) for transferring the toner image from the photosensitive member to a transferring material such as a paper sheet, a cleaning apparatus (performing a cleaning process) for removing the toner somewhat remaining on the photosensitive member after the transferring process to clean the surface of the photosensitive member, and a fixing apparatus (performing a fixing process) for fixing the toner image on the transferring material, etc. The photosensitive member is subjected to the electrophotography process (including the charging, exposing, developing, transferring, and cleaning processes) repeatedly for forming an image.

The toner remaining on the photosensitive member after the transferring process is removed from the surface of the photosensitive member by the cleaning apparatus so as to be stored as waste toner. From the viewpoint of environment protection or the effective utilization of resources, it is preferable that the generation of such waste toner be eliminated.

In view of this, some image forming apparatus return the transfer residual toner (i.e., so-called waste toner) collected by the cleaning apparatus to the developing apparatus for reuse or recycling.

On the other hand, it has been proposed to do away with the cleaning apparatus to make an image forming apparatus a cleanerless system. In the cleanerless image forming apparatus, the transfer residual toner remaining on the photosensitive member after the transferring process is removed and recovered for reuse by cleaning simultaneous with developing.

For such an image forming apparatus, U.S. Pat. No. 6,421,512 proposes a structure having toner-charge-amount-control means for imparting an electrical charge to the transfer residual toner to control the charge amount of the toner, so that the toner is recovered and reused by the developing apparatus.

In such an apparatus, if a fixed brush-like member is used as the above-mentioned toner-charge-amount-control means to control the tribo (triboelectricity) of the transfer residual toner to an appropriate charge amount with a normal polarity, slight overcharging of the transfer residual toner sometimes occurs. When the overcharging of the transfer residual toner occurs, the mirroring force of the photosensitive member and the overcharged toner is so strong that the toner does not adhere to the contact charging apparatus, recovered by the developing apparatus, nor is it transferred by the transferring means. Consequently, the toner will melt and adhere to the surface of the photosensitive member to produce a defective image.

It turned out that the cause of the above problem was that the fixed brush-like member as the toner-charge-amount-control means continues to stay at the same position on the photosensitive member. Specifically, when the resistance of the toner-charge-amount-control means is uneven, either overcharging or insufficient charging occurs at the same position on the photosensitive member. In the area in which the overcharging is occurring, the above-mentioned problem of the slight overcharging of the transfer residual toner and its adhering on the surface of the photosensitive member would arise. On the other hand, in the area in which the insufficient charging is occurring, another problem that the contact charging member is contaminated with the toner adhering thereto due to insufficient charging of the transfer residual toner would arise.

With the recent diversification of user's needs, successive printing of images having high coverage rates (such as photographic images) is sometimes performed. In addition, with the development of color printing, a multiple-developing process is applied to the photosensitive member. These processes generate a large amount of transfer residual toner at one time, which exaggerates the above-mentioned problems.

SUMMARY OF THE INVENTION

An object of the present invention is to provide a drive transmission mechanism for processing means in which variations in a load applied by the processing means to an image bearing member are prevented from occurring. It is also an object of the present invention to provide a cartridge provided with such a drive transmission mechanism.

Another object of the present invention is to provide a drive transmission mechanism for processing means that realizes stabilization of an abutting condition of the processing means against an image bearing member. It is also an object of the present invention to provide a cartridge provided with such a drive transmission mechanism.

Another object of the present invention is to provide a drive transmission mechanism for processing means that prevents disadvantages caused by the contact of the processing means with the same portion on an image bearing member. It is also an object of the present invention to provide a cartridge provided with such a transmission mechanism.

Another object of the present invention is to provide a drive transmission mechanism for processing means that is suitable for allowing the processing means to reciprocate in the longitudinal direction of an image bearing member. It is also an object of the present invention to provide a cartridge provided with such a drive transmission mechanism.

Other objects and features of the present invention will become more apparent by reading the following detailed description with reference to the annexed drawings.

DETAILED DESCRIPTION OF THE PREFERRED EMBODIMENTS

In the following, an electrophotographic color image forming apparatus according to the present invention will be specifically described with reference to the annexed drawings. In the following description, the term "longitudinal direction" refers to a direction that is perpendicular to the conveying direction of the recording media and identical to the axial direction of an electrophotographic photosensitive member (which will be referred to as a photosensitive drum hereinafter). In addition, "right" and "left" are defined by looking in the conveying direction of the recording media. Furthermore, "top" and "bottom" (or "upper" and "lower") are defined in the state in which a cartridge is mounted on the apparatus.

(Description of the Overall Structure of the Image Forming Apparatus)

First, the overall structure of the electrophotographic color image forming apparatus will be described with reference to FIG. 1.

Figure 1:
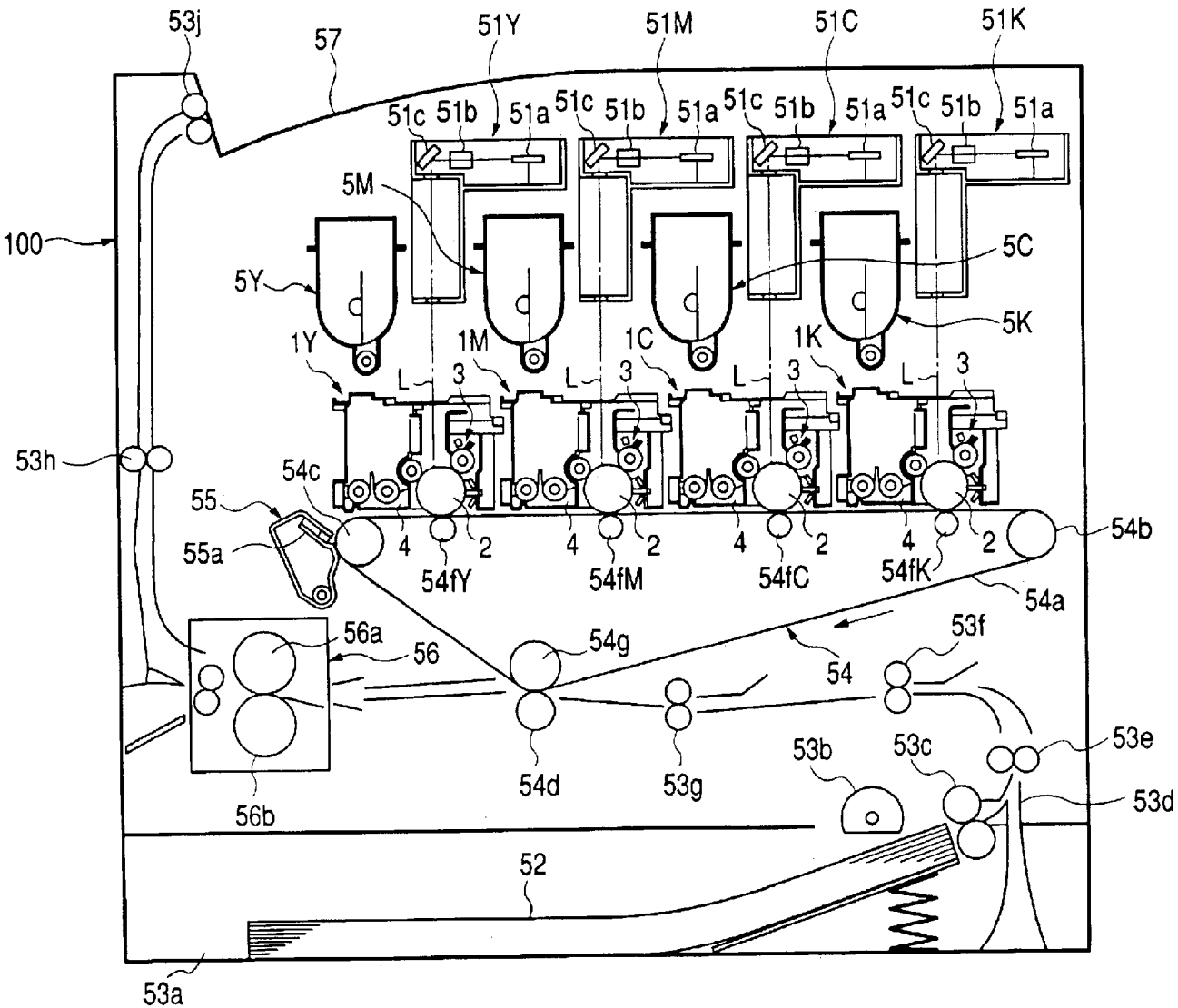
FIG. 1 is a cross sectional view showing a body of an image forming apparatus according to an embodiment of the present invention.

FIG. 1 is a drawing schematically illustrating the overall structure of a color laser beam printer as an embodiment of a color toner image forming apparatus.

The image forming portion of the color laser beam printer includes four process cartridges 1Y, 1M, 1C and 1K (corresponding to yellow, magenta, cyan and black respectively) which are respectively provided with photosensitive drums 2 serving as image bearing members and exposing means 51Y, 51M, 51C or 51K (in the form of laser beam scanning optical systems) corresponding to the respective colors that are disposed side by side above the process cartridges 1Y, 1M, 1C and 1K.

Below the image forming portion, there is provided feeding means for feeding recording media 52, an intermediate transferring belt or member 54*a* serving as an image receiving member on which toner images formed on the photosensitive drums are to be transferred, and a secondary transferring roller 54*d* for transferring toner images formed on the intermediate transferring belt 54*a* onto recording media 52. The apparatus is further provided with fixing means for fixing recording media 52 on which the toner images have been transferred, and discharging means for discharging the recording media 52 to the exterior of the apparatus and stacking them in place.

The recording medium 52 includes a paper sheet, an OHP sheet or a cloth, etc.

The image forming apparatus according to this embodiment is an apparatus of a cleanerless system. Therefore, transfer residual toner remaining on the photosensitive drum 2 is to be recovered in the developing means, and no special cleaner for recovering/storing the transfer residual toner is provided in the process cartridge.

In the following, the structure of each part of the image forming apparatus will be specifically described part by part.

(Sheet Feeding Portion)

The sheet feeding portion is to feed recording media to the image forming portion. The sheet feeding portion is composed mainly of a feeding cassette 53*a* accommodating a stack of a plurality of recording media 52, a feeding roller 53*b*, retard rollers 53*c* for preventing double feeding, a feeding guide 53*d* and registration rollers 53*g*. The feeding roller 53*b* is driven to rotate in synchronization with the image forming operation of the apparatus for feeding the recording media separately from the feeding cassette 53*a* sheet by sheet.

Each recording medium 52 is guided by the feeding guide 53*d* and conveyed to the registration rollers 53*g* via conveying rollers 53*e* and 53*f*.

At the moment just after the arrival of the recording medium 52, the registration rollers 53*g* stop rotating, and the recording medium 52 abuts the nip of the registration rollers 53*g* in that state, so that skew feeding of the recording medium 52 is corrected.

During the image forming operation of the apparatus, the registration rollers 53*g* are operated in accordance with a prescribed sequence including a non-rotating state for suspending the advancement of the recording medium 52 and a rotating state for conveying the recording medium 52 toward the intermediate transferring belt 54*a*. Thus, in the next process of the transferring, the toner image and the recording medium 52 are aligned appropriately.

(Process Cartridge)

Each of the process cartridges 1Y, 1M, 1C and 1K is formed as a unit including the photosensitive drum 2, serving as an image bearing member, and charging means and developing means that are disposed around the photosensitive drum 2. The process cartridge can be easily detached from the body of the image forming apparatus by a user for replacement, when its service life expires.

The apparatus of this embodiment is adapted, for example, to count the number of the rotations of the photosensitive drum 2, and when the count exceeds a prescribed value, to inform the user of the expiration of the service life of the process cartridge.

The photosensitive drum 2 of the present embodiment is an organic photosensitive member having a negative charge polarity. The photosensitive drum 2 includes an aluminum drum base body of a diameter of about 30 mm, a photosensitive layer of a normally used material formed thereon, and a charge injection layer provided as the outermost layer. The photosensitive drum 2 is rotated at a prescribed process speed, which is about 117 mm/sec in this embodiment.

The charge injection layer is formed as a coating layer made of a material including an insulative resin binder dispersed with electrically conductive particles, such as ultra-fine particles of $SnO_2$. The charge injection layer is not indispensable.

Figure 4:
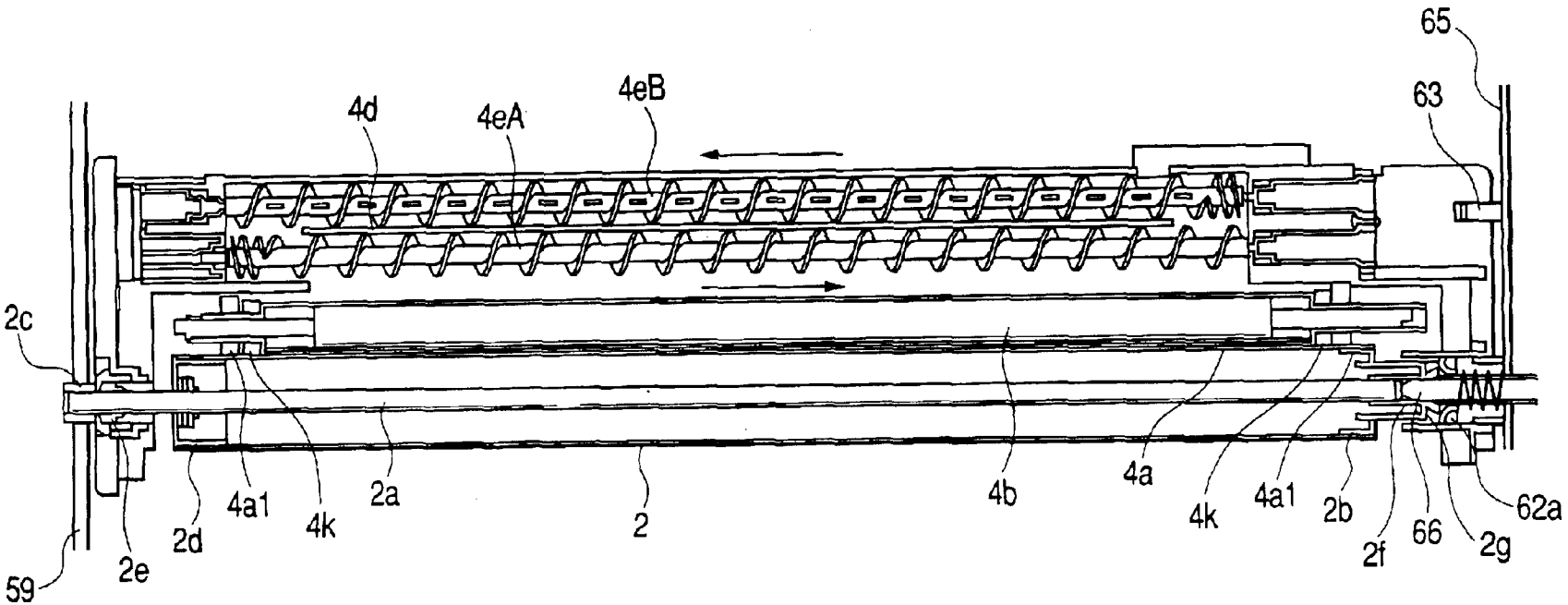
FIG. 4 is a longitudinal cross sectional view showing the process cartridge according to the embodiment of the present invention.

As shown in FIG. 4, a drum flange 2*b* is secured to the rear (or farther) end of the photosensitive drum 2, while a non-drive flange 2*d* is secured to the front (or near) end of the photosensitive drum 2. A drum shaft 2*a* passes through the center of the drum flange 2*b* and the center of the non-drive flange 2*d*, so that the drum shaft 2*a*, the drum flange 2*b* and the non-drive flange 2*d* are rotated integrally. In other words, the drum 2 is rotated about the axis of the drum shaft 2*a*.

The drum shaft 2 is rotatably supported by a bearing 2*e* at its front side end portion. The bearing 2*e* is secured to a bearing case 2*c*, which is in turn secured to a frame of the process cartridge.

(Charging Means)

The charging means 3, which serves as a charging apparatus, utilizes contact charging. In this embodiment, a charging roller 3*a* is used as a charging member. The charging roller 3*a* is in contact with the photosensitive member 2.

Figure 2:
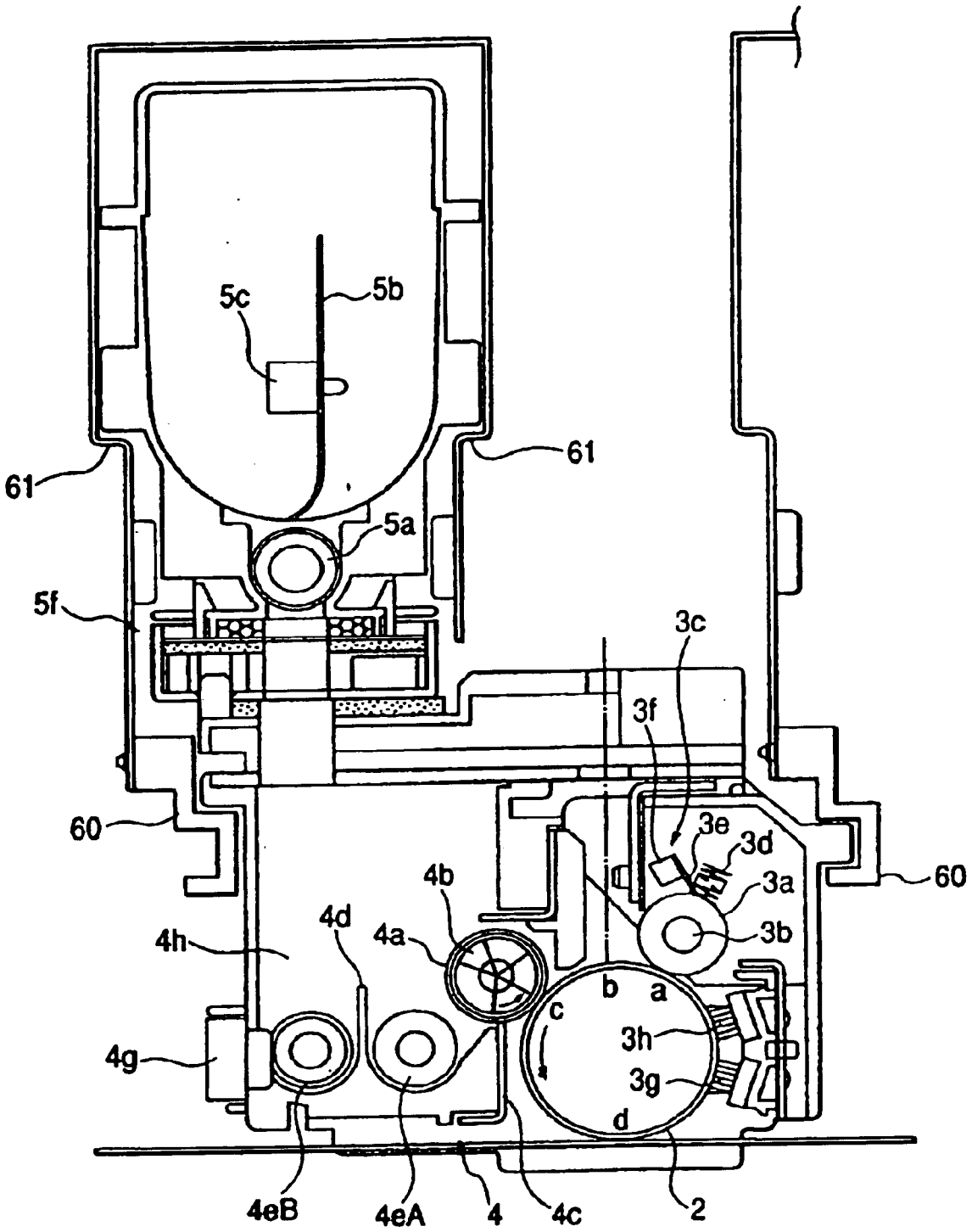
FIG. 2 is a cross sectional view showing a process cartridge and a toner replenishment container according to the embodiment of the present invention.
Figure 3:
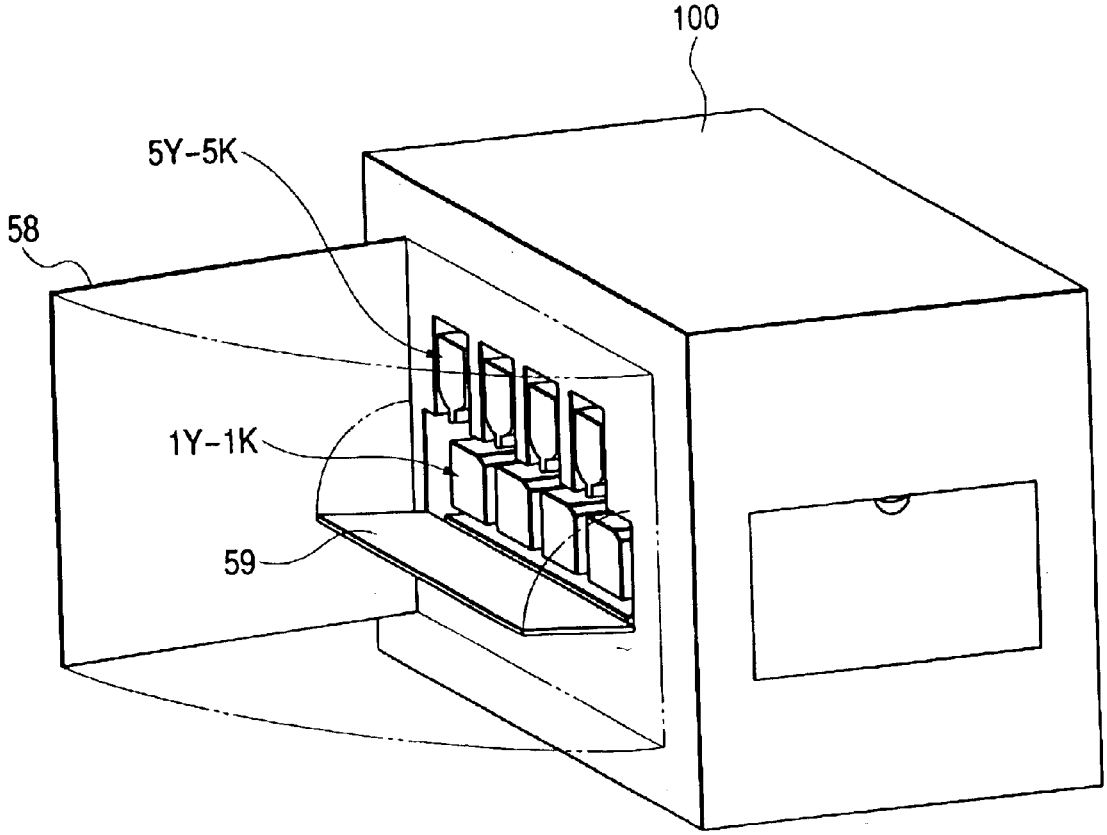
FIG. 3 is a perspective view schematically showing the body of the image forming apparatus according to the embodiment of the present invention.

As shown in FIG. 2, both ends of the center core metal 3*b* of the charging roller 3*a* are rotatably supported by bearing members (not shown), and the charging roller 3*a* is urged by a spring 3*d* against the surface of the photosensitive drum 2 with a prescribed pressing force, so that the charging roller is rotated with the rotation of the photosensitive drum 2.

Reference sign 3*c* designates a cleaning unit for the charging roller. The cleaning unit 3*c* cleans the charging roller 3*a* with an elastic cleaning film 3*e*. The cleaning film 3*e* is disposed parallel to the longitudinal direction of the charging roller 3*a*. One end of the cleaning film 3*e* is secured to a support member 3*f* that is reciprocated along the longitudinal direction within a prescribed range. The cleaning film 3*e* is disposed in such a way that its surface near the free end forms a contact nip together with the charging roller 3*a*. The toner adhering to the charging roller 3*a* is spread over the surface of the charging roller 3*a* by means of the cleaning film 3*e* and frictionally charged by the film 3*e* with the charge polarity of the normal toner.

Figure 6:
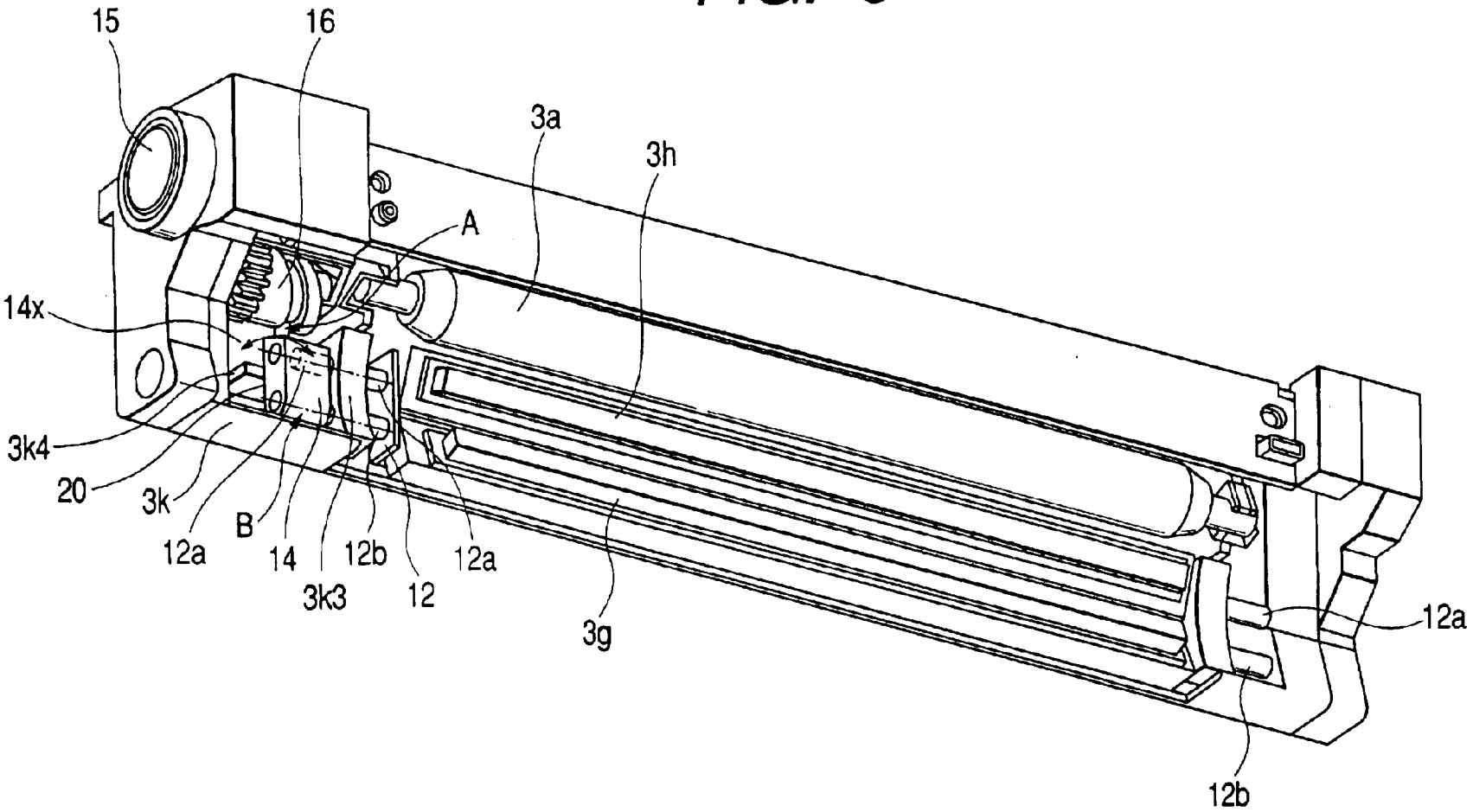
FIG. 6 is a perspective view schematically showing a charging unit according to the embodiment of the present invention.
Figure 7:
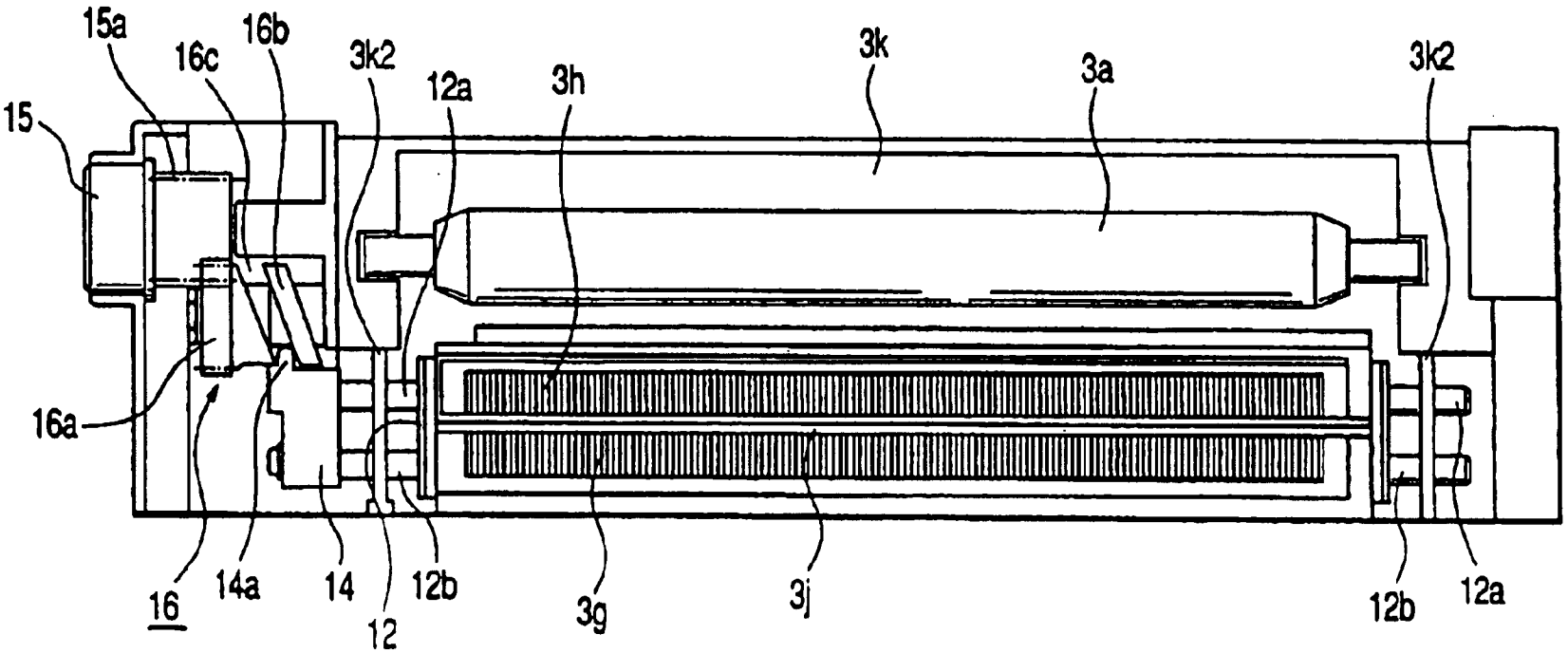
FIG. 7 is a longitudinal view showing the charging unit according to the embodiment of the present invention.

FIGS. 6 and 7 show a portion of the process cartridge. The above-mentioned support member 3*f* is provided in such a way as to be movable in the longitudinal direction within a certain range, so that it would be reciprocated by a reciprocating mechanism over that range. Specifically, as shown in FIGS. 6 and 7, a rotational driving force is transmitted from external driving means that is provided in the body of the image forming apparatus to a coupling 15 provided in the process cartridge. The rotational driving force is further transmitted from a coupling gear portion 15*a* to a cam gear 16*a*. A cam portion 16*b* rotates integrally with the cam gear 16*a*, which functions as a driving force imparting member, so as to push the support member 3*f* in one direction along the longitudinal direction. On the other hand, the other side of the support member 3*f* is urged by a return spring. Therefore, when the cam gear 16*a* rotates, the support member 3*f* reciprocates along the cam portion 16*b* with a constant stroke length of 5 mm.

Thus, the cleaning film 3*e* slides on the surface of the charging roller 3*a* while in frictional contact with it, so that accretion (such as fine powder of the toner or external additives) on the surface of the charging roller would be removed.

The image forming apparatus according to this embodiment employs a cleanerless system. In the following, a description will be provided of the cleanerless system.

(Cleanerless System)

First, referring to FIG. 2, the general outline of the operation of the cleanerless system in the image forming apparatus according to this embodiment is to bring, with the subsequent rotation of the photosensitive drum, the transfer residual toner remaining on the photosensitive drum 2 after the transferring process to a developing portion c through a charging portion a and an exposing portion b, so as to perform cleaning (or recovery) by means of the developing apparatus simultaneously with developing.

Since the transfer residual toner on the surface of the photosensitive drum 2 passes through the exposing portion b, the exposing process is applied over the transfer residual toner. However, the amount of the transfer residual toner is small, and so it does not matter so much.

The transfer residual toner just after the transferring process is a mixture of toner charged in the normal polarity, toner charged in the opposite polarity (which will be referred to as inverted toner) and insufficiently charged toner. The inverted toner and the insufficiently charged toner would adhere to the charging roller 3*a* upon passing through the charging portion a, so that the charging roller 3*a* could be contaminated with toner to so inadmissible an extent that the contamination causes deficient charging.

In order for the cleaning simultaneous with developing of the transfer residual toner on the surface of the photosensitive drum to be performed effectively by the developing apparatus, it is necessary that the charge polarity of the transfer residual toner on the photosensitive drum that is to be brought to the developing portion c is normal and the amount of the charge is sufficient for the development of an electrostatic latent image on the photosensitive drum by the developing apparatus. In other words, if the inverted toner and the insufficiently charged toner cannot be removed or recovered from the surface of the photosensitive drum to the developing apparatus, they will cause the production of poor copies.

With the recent diversification of user's needs, successive printing of images having high coverage rates (such as photographic images) is sometimes performed. This and other processes generate a large amount of transfer residual toner at one time, which aggravates the above-mentioned problem.

In view of the above, in this embodiment, transfer residual toner (or residual developer image) uniformizing means 3*g* for uniformizing the transfer residual toner on the photosensitive drum 2 is provided at a position downstream (with respect to the rotation of the photosensitive drum 2) of the transferring portion d, and toner (or developer) charge control means 3*h* for making the charge polarity of the transfer residual toner negative (that is, the normal polarity) is provided at a position downstream (with respect to the rotation of the photosensitive drum 2) of the transfer residual toner uniformizing means 3*g* and upstream (with respect to the rotation of the photosensitive drum 2) of the charging portion a.

With the provision of the transfer residual toner uniformizing means 3*g*, the transfer residual toner that is present in a pattern on the photosensitive drum 2 to be brought from the transferring portion d to the toner charge control means 3*h* is dispersed over the surface of the photosensitive drum so as to not be in a pattern, even when the amount of the transfer residual toner is large. This can prevent the concentration of the toner at a certain part of the toner charge control means 3*h*. Therefore, the toner charge control means 3*h* can sufficiently control the charge of the whole of the transfer residual toner to the normal polarity. Consequently, adhesion of the transfer residual toner to the charging roller 3*a* can be effectively prevented. In addition, the generation of a ghost image due to a transfer-residual-toner-image pattern is also prevented.

In this embodiment, the transfer residual toner uniformizing means 3*g* and the toner charge control means 3*h* comprise brush members having appropriate electric conductivities. The brush members are disposed in such a way as to be in contact with the surface of the photosensitive drum 2. To the transfer residual toner uniformizing means 3*g*, a voltage with the polarity opposite to the normal polarity is applied, while to the toner charge control means 3*h*, a voltage with the polarity the same with the normal polarity is applied.

The transfer residual toner uniformizing means 3*g* and the toner charge control means 3*h* are adapted to be moved (reciprocated), by a drive source (not shown) provided in the body of the image forming apparatus, in the longitudinal direction of the photosensitive drum. With this feature, the transfer residual toner uniformizing means 3*g* and the toner charge control means 3*h* do not keep the same positions relative to the photosensitive drum. Therefore, even if overcharge or insufficient charge is generated due to, for example, unevenness in the resistance of the toner charge control means 3*h*, they do not occur always at the same portion or position on the surface of the photosensitive drum. Consequently, it is possible to prevent or reduce melt adhesion of the transfer residual toner to the photosensitive drum 2 due to slight overcharge of the transfer residual toner and adhesion of the transfer residual toner to the charging roller 3*a* due to insufficient charging of the transfer residual toner. By passing through the transfer residual toner uniformizing means 3*g* and the toner charge amount control means 3*h*, the transfer residual toner has been charged to a polarity that is the same as the normal charge polarity of the toner, that is the same as the polarity of the voltage applied to the charging roller 3*a*. Consequently, adhesion of the transfer residual toner to the charging roller 3*a* is prevented from occurring, and the efficiency of recovery of the transfer residual toner to the developing apparatus 4 is enhanced.

(Exposing Means)

In this embodiment, the exposure of the photosensitive drum 2 is performed by laser exposing means. Specifically, an image signal is sent from the body of the apparatus, and the uniformly charged surface of the photosensitive drum 2 is exposed in a scanning manner to a laser beam L that is modulated in accordance with that signal. Thus, an electrostatic latent image corresponding to the image information is selectively formed on the surface of the photosensitive drum 2.

As shown in FIG. 1, the laser exposing means is composed of a solid state laser element (not shown), a polygon mirror 51*a*, imaging lens 51*b* and a reflection mirror 51*c*, etc. Based on the input image signal, the emission of light from the solid-state laser element is controlled by an emission light signal generator (not shown) so as to be turned on and off at a predetermined timing. The laser beam L emitted from the solid-state laser element is converted into a substantially parallel light flux by a collimator lens system (not shown) and scanned by the polygon mirror 51*a* that is rotating at a high rate. Then, the laser beam is imaged into a spot on the photosensitive drum 2 via the imaging lens 51*b* and the reflection mirror 51*c*.

As per the above description, the surface of the photosensitive drum 2 is exposed to laser beam L in a scanning manner, with the scanning in the main scanning direction being attained by the scanning of the laser beam and the scanning in the sub-scanning direction being attained by the rotation of the photosensitive drum 2. Thus, an exposure distribution in conformity with the image signal is realized on the surface of the photosensitive drum 2. In other words, with the irradiation and non-irradiation of the laser beam L, a light portion potential at which the surface potential has decreased and a dark portion potential at which the surface potential has not decreased are generated. Thus, the electrostatic latent image corresponding to the image information is formed as the contrast between the light portion potential and the dark portion potential.

(Developing Means)

The developing apparatus 4 that serves as the developing means is a two-component contact developing apparatus (two-component magnetic brush developing apparatus), which has a developer composed of a carrier and a toner on a developing sleeve 4*a* that serves as a developer carrying member. The developing sleeve internally holds a magnet roller 4*b*. In the vicinity of the developing sleeve, there is provided a regulation blade 4*c* with a prescribed space therebetween. The regulation blade 4*c* forms a thin layer of the developer on the developing sleeve 4*a*, as the developing sleeve 4*a* rotates in the direction indicated by an arrow.

As shown in FIG. 4, the developing sleeve 4*a* has, at its both ends, journal portions 4*a*1 having reduced diameters to which spacers 4*k* are rotatably fitted, so that the developing sleeve 4*a* is disposed at a prescribed distance from the photosensitive drum 2. This structure is adjusted in such a way that upon developing, the developer applied on the developing sleeve is in contact with the photosensitive drum 2 for the development. The developing sleeve 4*a* is driven to rotate at a prescribed peripheral velocity in the counterclockwise direction as indicated by an arrow, which is the opposite direction from the rotation direction of the photosensitive drum 2 at the developing portion c.

The toner used in this embodiment is a negatively charged toner having an average diameter of 6 $\mu$m. The magnetic carrier used in this embodiment has an average diameter of 35 $\mu$m and a saturation magnetization of 205 emu/cm$^3$. The developer is the mixture of the toner and the carrier with a weight ratio of 6:94.

There is also provided a developer accommodating portion 4*h*, which is partitioned by a longitudinal dividing wall 4*d* into two compartments except for both end portions. Agitating screws 4*e*A and 4*e*B are disposed with the dividing wall 4*d* between them.

The toner supplied from the toner replenishment container falls to a position near the rear end of the agitating screw 4*e*B, from which the toner is carried toward the front side (with respect to the longitudinal direction) while being agitated, and then the toner passes through the front end portion at which the dividing wall 4*d* is not present. Then, the toner is carried further by the agitation screw 4*e*A toward the rear side (with respect to the longitudinal direction), and passes the rear end portion at which the dividing wall 4*d* is not present. Then, the toner is carried by the agitating screw 4*e*B while being agitated. As per the above, the toner continues to circulate.

Now, a description will be provided of a developing process for visualizing an electrostatic latent image formed on the photosensitive drum 2 through a two-component magnetic brush method by means of the developing apparatus 4. In addition, a circulating system for the developer will also be described.

With the rotation of the developing sleeve 4*a*, developer in the developing container is picked up onto the surface of the developing sleeve 4*a* at a pickup pole of the magnet roller 4*b* so as to be carried.

While the toner is carried with the rotation of the developing sleeve 4*a*, the thickness of the developer layer is regulated by the regulating blade 4*c* that is disposed perpendicularly to the developing sleeve 4*a*, so that a thin layer of the developer is formed on the developing sleeve 4*a*. When the developer in the form of a thin layer reaches a developing pole corresponding to the developing portion, "magnetic bead chains" of developer are formed by a magnetic force. The electrostatic latent image on the surface of the photosensitive drum 2 is developed by the toner included in this fuzzed developer as a toner image. In this embodiment, the electrostatic latent image is reverse developed.

After passing through the developing portion, the thin layer of the developer on the developing sleeve 4*a* is carried further with the rotation of the developing sleeve 4*a* to enter the developing container, in which the developer is detached from the developing sleeve by a repulsive magnetic field generated by a carrying pole so as to be returned to the developer pool in the developing container.

A DC (direct current) voltage and an AC (alternating current) voltage are applied to the developing sleeve 4*a* by a power source (not shown). In this embodiment, a DC voltage of −500V and an AC voltage having a frequency of 2000 Hz and a peak-to-peak voltage of 1500V are applied to the developing sleeve, and only the exposed portion on the photosensitive drum 2 is selectively developed.

In the two-component developing system in general, application of an AC voltage involves a risk of the generation of fog in images, though it enhances the efficiency of development and the quality of images. For this reason, generally, a potential difference is set between the voltage applied to the developing sleeve 4*a* and the surface potential of the photosensitive drum 2 so as to prevent the fog from being generated. More specifically, a bias voltage between the potential of the exposed portion and the potential of the non-exposed portion of the photosensitive drum 2 is applied.

As the toner is consumed by development process, the concentration of the toner in the developer decreases. In this embodiment, a concentration sensor 4*g* for detecting the concentration of the toner is provided at a position near the outer peripheral surface of the agitating screw 4*e*B. When it is detected by the sensor 4*g* that the concentration of the toner in the developer becomes lower than a predetermined concentration level, a command for replenishing the developing apparatus with toner from the toner replenishment container is generated. With this toner replenishment operation, the concentration of the toner in the developer is controlled to maintain a prescribed level.

(Toner Replenishment Container)

The toner replenishment containers 5Y, 5M, 5C and 5K are disposed side by side above the respective process cartridges 1Y, 1M, 1C and 1K. The toner replenishment containers 5Y, 5M, 5C and 5K are attached to the body 100 of the apparatus from its front side.

As shown in FIG. 2, the toner replenishment container is provided, in its interior, with agitating plates 5*b* that are secured to an agitating shaft 5*c*, and a screw 5*a*. The toner replenishment container has a discharge opening 5*f* for discharging toner that is formed at the bottom of the container.

Figure 5:
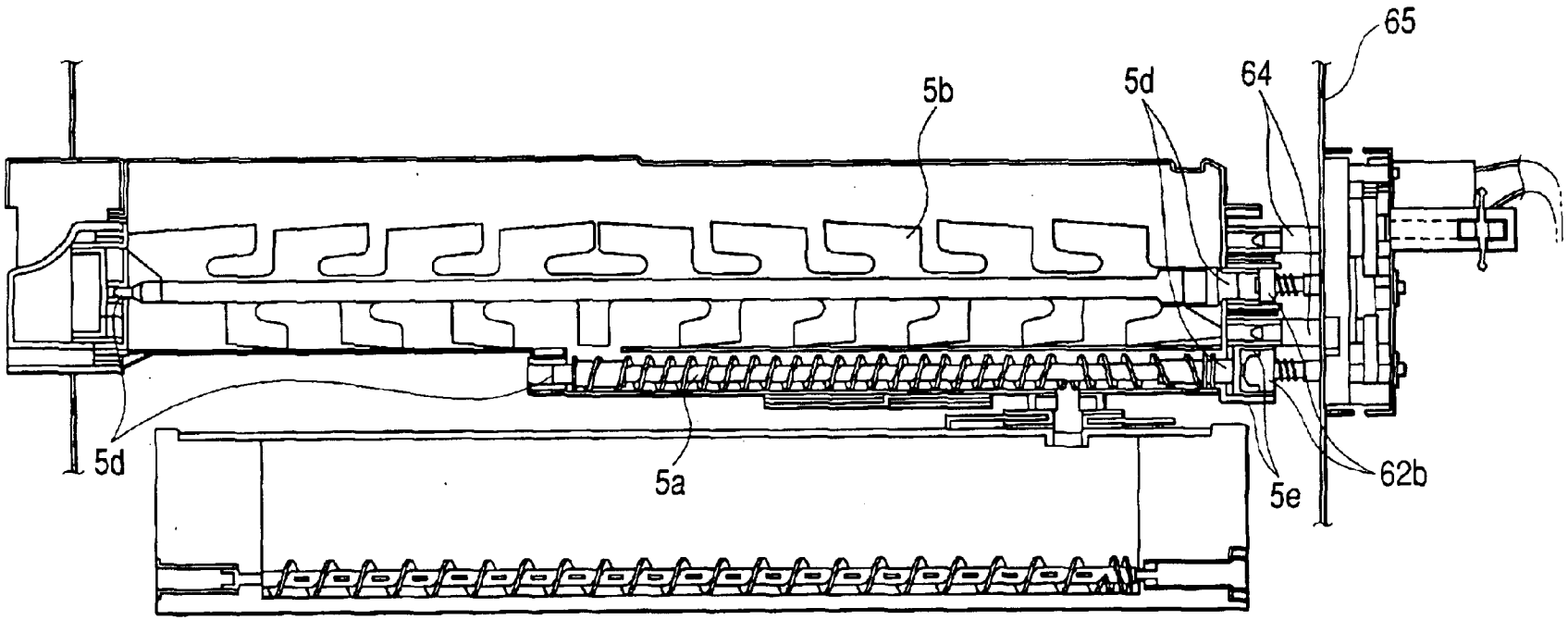
FIG. 5 is a longitudinal cross sectional view showing the toner replenishment container according to the embodiment of the present invention.

As shown in FIG. 5, the screw 5*a* and the agitating shaft 5*c* are rotatably supported at their both end portions by bearings 5*d*. At one end of each of the screw 5*a* and the agitating shaft 5*c*, a drive coupling (concave) 5*e* is disposed. The drive coupling (concave) 5*e* is adapted to receive a drive force from a drive coupling (convex) 62*b in* the body of the apparatus so as to be rotated. The outer contour of the screw 5*a* is shaped like a spiral rib, the spiral direction of which is reversed across the position at which the discharge opening 5*f* is disposed.

The rotation of the drive coupling (convex) 62*b* causes the screw 5*a* to rotate in a prescribed rotation direction. Toner is carried toward the discharge opening 5*f* and free falls from the aperture of the discharge opening 5*f* to replenish the process cartridge with toner. The radially outer edge of the agitating plate 5*b* is slanted, and when it slides on the wall of the toner replenishment container with a frictional contact, the outer edge abuts the wall at a certain angle. More specifically, the outer edge of the agitating plate 5*b* is distorted into a spiral shape. With the slanting distortion of the outer edge of the agitating plate 5*b*, a carrying force in the axial direction is generated, which carries the toner in the longitudinal direction.

The toner replenishment container of this embodiment is not limited for use in a two-component developing system, but it can also be used for replenishing a process cartridge or a developing cartridge that utilizes a one-component developing system. In addition, it is apparent that the powder to be accommodated in the toner replenishment container is not limited to a toner, but it may be a so-called developer, that is a mixture of a toner and a magnetic carrier.

(Transferring Means)

An intermediate transferring unit 54 that serves as transferring means is a unit for secondarily transferring a plurality of toner images, which have been primarily transferred from the photosensitive drum in a superposed manner, to the recording medium 52 at one time.

The intermediate transferring unit 54 includes an intermediate transferring belt 54*a* functioning as an image receiving member that runs in the direction indicated by an arrow in FIG. 1. The intermediate transferring belt 54*a* runs in the clockwise direction indicated by the arrow shown in FIG. 1 at a peripheral velocity substantially the same as that of the photosensitive drum 2. The intermediate transferring belt 54*a* is an endless belt with a peripheral length of about 940 mm, which is looped around three rollers, namely, a driving roller 54*b*, a secondary transfer opposing roller 54*g* and a driven roller 54*c*.

Inside the loop of the intermediate transferring belt 54*a*, there are provided transfer charging rollers 54*f*Y, 54*f*M, 54*f*C and 54*f*K. The transfer charging rollers 54*f*Y, 54*f*M, 54*f*C and 54*f*K are rotatably disposed at positions opposed to respective photosensitive drums 2 and are urged against the photosensitive drums.

The transfer charging rollers 54*f*Y, 54*f*M, 54*f*C and 54*f*K are supplied with electric power from a high voltage power source (not shown) to perform charging with the polarity opposite to that of the toner from the backside of the intermediate transferring belt 54*a*, so that the toner images on the photosensitive drums 2 are primarily transferred onto the upper surface of the intermediate transferring belt 54*a*.

At a secondary transferring portion, there is provided a secondary transfer roller 54*d*. The secondary transfer roller

54*d* is disposed at a position opposed to the secondary transfer opposing roller 54*g* in such a way as to be in pressure contact with the intermediate transferring belt 54*a*. The secondary transfer roller 54*d* is movable in the up-and-down direction in FIG. 1 and driven to be rotated. While the secondary transfer roller 54*d* is rotating, a bias is applied to the intermediate transfer belt 54*a* and so the toner image on the intermediate transferring belt 54*a* is transferred onto a recording medium 52.

In the above-described process, the intermediate transferring belt and the secondary transfer roller 54*d* are being driven respectively. When the recording medium 52 enters the secondary transferring portion, a prescribed bias is applied to the secondary transfer roller 54*d*, so that the toner image on the intermediate transferring roller 54*a* is secondarily transferred onto the recording medium 52.

During that process, the recording medium 52, which is sandwiched between the intermediate transferring belt 54*a* and the secondary transfer roller 54*d*, is subjected to the transferring process and, at the same time, conveyed leftward at a prescribed velocity to a fixing device 56 that performs the next process.

At the downstream-most position, with respect to the transferring process, of the intermediate transferring belt, there is provided a cleaning unit 55 that can be in contact with and detached from the surface of the intermediate transferring belt 54*a* to remove the transfer residual toner remaining on the intermediate transferring belt 54*a* after the secondary transfer.

In the interior of the cleaning unit 55, there is provided a cleaning blade 55*a* for removing the transfer residual toner. The cleaning unit 55 is adapted to swing about a pivot (not shown) and is in pressure contact with the intermediate transferring member 54*a*. The transfer residual toner collected into the cleaning unit 55 is carried by a feed screw to a waste toner tank (not shown) and stored therein.

As the material for the intermediate transferring belt 54*a*, a polyimide resin may be used. The material for the transferring belt is not limited to the polyimide resin, but other plastics such as a polycarbonate resin, a polyethylene terephthalate resin, a poly(vinylidene fluoride) resin, a polyethylene naphthalate resin, a polyetheretherketone resin, a polyethersulphone resin and a polyurethane resin, or a fluorinated rubber or a silicone rubber may also be preferably used.

(Fixing Portion)

The toner image formed on the photosensitive drum 2 by the developing means is transferred onto the recording medium 52 via the intermediate transferring belt 54*a*. The fixing device 56 fixes the toner image, which has been transferred on the recording medium 52 with heat.

As shown in FIG. 1, the fixing device 56 includes a fixing roller 56*a* for applying heat to the recording medium 52, and a pressure roller 56*b* for pressing the recording medium 52 against the fixing roller 56*a*. These rollers 56*a* and 56*b* have hollow structures. In the interior of each of the rollers, there is provided a heater (not shown). The rollers are driven to rotate so as to convey or forward the recording medium 52 simultaneously.

Specifically, while the recording medium 52 that bears the toner image is conveyed by the fixing roller 56*a* and the pressure roller 56*b*, the toner image is applied with heat and pressure so as to be fixed on the recording medium. The fixed recording medium 52 is discharged by the discharging rollers 53*h* and 53*j* and placed on a tray 57 provided on the body of the image forming apparatus.

(Attachment of Process Cartridge and Toner Replenishment Container)

In the following, a process for attaching the process cartridge and the toner replenishment container will be described with reference to FIGS. 2, 3, 4 and 5.

On the front side of the body 100 of the image forming apparatus, there is provided a front door 58 that is openable and closable. When the front door 58 is opened, an opening for inserting the process cartridges and the toner replenishment containers is exposed.

At a portion of the opening at which the process cartridges are to be inserted, there is provided a centering plate 59, which is pivotably mounted. This centering plate 59 should be opened before inserting/pulling-out the process cartridge.

As shown in FIG. 2, a guide rail 60 for guiding the attachment of the process cartridge and a guide rail 61 for guiding the attachment of the toner replenishment container are secured in the interior of the body 100 of the apparatus.

The direction of insertion of the process cartridge and the toner 5 replenishment cartridge is parallel to the axial direction of the photosensitive drum 2, and so the guide rails 60 and 61 also extend in the same direction. When inserted, the process cartridge and the toner replenishment container are once slid along the guide rails 60 and 61 respectively from the front side toward the back side.

When the process cartridge is inserted to the backmost position, a centering shaft 66 provided on the body of the apparatus fits into a center hole 2*f* of the drum flange 2*b*, as shown in FIG. 4, so that the back side rotation center position of the photosensitive drum 2 is aligned relative to the body of the apparatus. At the same time, a drive transmitting portion 2*g* formed on the drum flange 2*b* and the drive coupling (convex) 62*a* are coupled to each other, so that rotational driving of the photosensitive drum 2 is enabled.

The drive transmitting portion 2*g* used in this embodiment has a distorted triangular pole shape, which enables the transmission of the drive force, when a driving force is applied by the body of the apparatus, and generates a force for pulling the photosensitive drum 2 toward the back side.

On a back plate 65, there is provided a support pin 63 for aligning the process cartridge. The support pin 63 fits into a frame of the process cartridge to fix the position of the frame of the process cartridge.

The body 100 of the apparatus is provided with the pivotally movable centering plate 59 at its front side, to which the bearing case 2*c* for the process cartridge is securely supported. With the above-described series of inserting operations, the photosensitive drum 2 and the process cartridge are aligned or positioned relative to the body of the apparatus.

Referring to the toner replenishment container, when inserted to the backmost position, the toner replenishment container is fixed to support pins 64 that are projecting from the back plate 65. At the same time, the drive coupling (concave) 5*e* and the drive coupling 62*b* (convex) are coupled to each other, so that rotational driving of the screw 5*a* and the agitating shaft 5*c* is enabled.

(Structure of Brush Unit of Charging Means)

Figure 8:
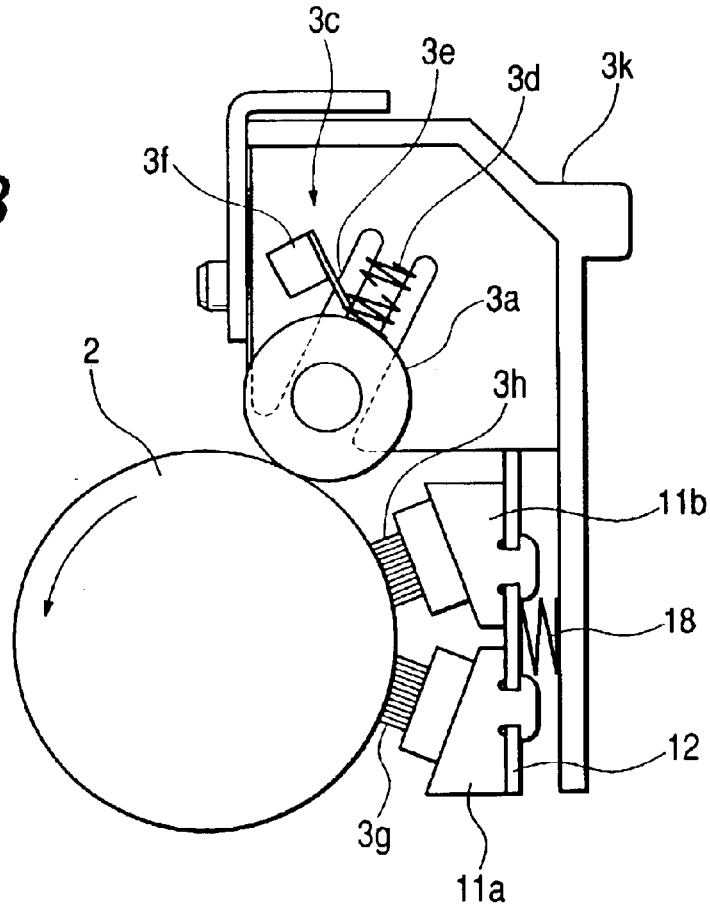
FIG. 8 is a longitudinal cross sectional view showing the charging unit according to the embodiment of the present invention.
Figure 9:
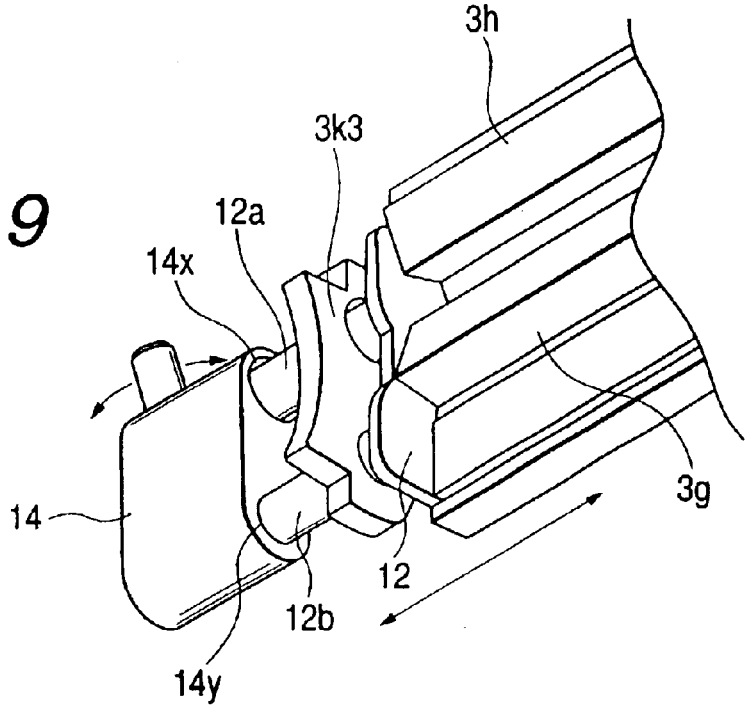
FIG. 9 is a perspective view schematically showing an end portion of processing means of the charging unit according to the embodiment of the present invention.

In the following a description will be made, with reference to FIGS. 6 to 9, of the structure of a brush unit composed of the above-mentioned transfer residual toner uniformizing means 3*g* and the toner charge control means 3*h*, which are adapted to be able to reciprocate in the longitudinal direction of the photosensitive drum 2. In this connection, FIG. 6 is a perspective view illustrating the charging means that is structured as a cleanerless system, FIG. 7 is a longitudinal view illustrating the charging means structured as a cleanerless system, FIG. 8 is a longitudinal cross sectional view illustrating the charging means structured as a cleanerless system, and FIG. 9 is a perspective view of an end portion of the processing means of the charging means structured as a cleanerless system.

A brush unit 3*j*, which is a unit composed of the transfer residual toner uniformizing means 3*g* and the toner charge control means 3*h*, is formed by fixing the transfer residual toner uniformizing means 3*g* to a brush support 11*a*, serving as a supporting member, that is secured to a brush support member 12 in the form of a sheet metal by heat caulking or by using a screw or a double-sided adhesive tape, and fixing the toner charge control means 3*h* to a brush support 11*b*, serving as a supporting member, that is secured to the brush support member 12.

At both ends of the brush support member 12, shafts 12*a* and 12*b* extend in the longitudinal direction of the photosensitive drum, as shown in FIG. 7. A transmission arm member 14, also called a reciprocal movement transmission arm, is attached to the shafts 12*a* and 12*b*, also called brush unit pins, at one side (the drive side). The transfer residual toner uniformizing means 3*g* and the toner charge control means 3*h* are disposed in angled or inclined states, respectively, in such a way as to face toward the center of the photosensitive drum 2.

As described above, the brush unit 3*j* is a unit that includes the transfer residual toner uniformizing means 3*g* and the toner charge control means 3*h*, both of which are integrally secured to the brush support member 12, and the transfer residual toner uniformizing means 3*g* and the toner charge amount control means 3*h* are used in such a way that the top end portion of each means is in contact with the surface of the photosensitive drum 2. The brush support member 12 and the transmission arm member 14 constitute supporting means for supporting the brush members 3*g* and 3*h* that serve as processing means.

(Structure for Reciprocation of Brush)

In this embodiment, the brush unit 3*j* is supported by a compressed coil spring 18 (see FIG. 8) in a state in which the brush unit is urged to the photosensitive drum 2, and the brush unit 3*j* can be reciprocated in the longitudinal direction of the photosensitive drum 2 by means of a brush unit supporting spacer 3*k*3 (see FIG. 6).

When the cartridge is attached to the body of the image forming apparatus, a rotational drive force is transmitted from a coupling (not shown) provided in the body of the apparatus to the coupling 15 (shown in FIG. 7) provided in the cartridge. The rotational drive force is further transmitted from the coupling gear 15*a* that is formed integrally with the coupling 15 to the cam gear 16*a* and the cam portion 16*b*, which constitute a cam member (drive force imparting member) 16 that serves as a rotational drive converting member. Furthermore, at the end of the brush support member 12, there is provided the reciprocal movement transmission arm 14 that serves as a driving force receiving member fixed thereto. When the cam gear 16*a* receives the rotational drive force from the body of the apparatus to rotate, a transmission arm pin 14*a* serving as a driving force receiving portion that is positioned in a cam groove 16*c*, which is formed obliquely to the axis of rotation of the cam, is reciprocated in the longitudinal direction along the cam groove 16*c*. In this embodiment, the reciprocation is performed at a constant cycle within the range of about 0.5 to 2.5 seconds and with a stroke length of 5 mm. Thus, the brush unit is reciprocated.

The reciprocal movement transmission arm 14 is adapted to be fitted with the brush unit pins 12*a* and 12*b*. As shown in FIG. 9, a pin hole 14*x* of the transmission arm is formed to be a little larger than the diameter the brush unit pin 12*a* so that there is play between them due to a clearance therebetween, while the brush unit pin 12*b* is rotatably assembled to a pin hole 14*y* of the transmission arm without play by means of an E-ring 20 (see FIG. 6). With this structure, the reciprocal movement transmission arm 14 is pivotally movable with one of the pins (i.e., pin 12*b*) being the pivot shaft portion within the range allowed by the play between the other pin 12*a* and the pin hole 14*x*.

With the above structure, if we let, as indicated in FIG. 6, the center of the brush unit pin 12*b* be a supporting portion B and the pin 14*a* of the reciprocal movement transmission arm 14 be a working portion A, when an unnecessarily heavy load is imposed on the working portion A, for example at an inflection point of the cam portion 16*b*, the load would be absorbed by the pivotal movement of the reciprocal movement transmission arm 14 about the supporting portion B within the range allowed by the play.

On the other hand, when the reciprocal movement transmission arm 14 pivots excessively, the contact between the brushes 3*g* and 3*h* and the photosensitive drum 2 becomes unstable. Therefore, in this embodiment, a regulation member 3*k*4, serving as regulating means, is provided to regulate the reciprocal movement transmission arm 14 in such a way that the pivotal movement of the reciprocal movement transmission arm 14 is limited within a prescribed range. In this embodiment, the regulation member 3*k*4 is disposed on a charging container 3*k* and at a position downstream of the cam portion 16*b* with respect to the rotation direction and between the working portion A and the supporting portion B. In connection with this, the member on which the regulating member is provided is not limited to the charging container 3*k*, but the regulating means may be provided on the reciprocal movement transmission arm 14, for example.

As shown in FIG. 6, the regulation member is a plate-like member. When the reciprocal movement transmission arm 14 is about to pivot by an amount exceeding a certain pivot amount within the range allowed by the play of the pin hole 14*x*, the reciprocal movement transmission arm 14 impinges against the regulation member 3*k*4 so that its pivotal movement is regulated. With this structure, the reciprocal movement transmission arm 14 is prevented from pivoting excessively. Therefore, the contact between the brushes 3*g* and 3*h* and the photosensitive drum 2 is stabilized, and a stable image forming operation can be realized without increasing the drive load on the photosensitive drum 2.

In the arrangement in which the number of the brush unit pins 12*a* and 12*b* is four, the flatness (or planarity) of the reciprocal movement of the brush unit is determined by three of those pins. Therefore, the accuracy of parallelism of the fourth pin relative to the other pins will affect the position of a brush unit supporting guide 3*k*2 (see FIG. 7) at the time of the reciprocal movement, which can impair stable contact against the photosensitive drum 2, depending on the circumstances.

In other words, there is a risk that an unnecessarily large biasing force might be generated in the abutting direction against the photosensitive drum 2 to affect the stable rotation of the photosensitive drum 2 or the wear thereof. In addition, in connection with the movement of the cam gear 16*a* and the cam portion 16*b*, there is a risk that a force larger than what is intended might be generated in the direction away from the photosensitive drum 2 to impair the reciprocal movement of the brush support member 12, also called the brush unit 12, with a prescribed clearance to the photosensitive drum 2.

In this embodiment, since the reciprocal movement transmission arm 14 is movable in the direction indicated by arrows shown in FIG. 9 by the movement amount allowed by the play between the brush unit pin 12*a* and the pin hole 14*x* of the transmission arm with the brush unit pin 12*b* being the pivot, the above-mentioned impairment can be prevented.

While in this embodiment, the brushes 3*g* and 3*h* are used as examples of the processing means, the structures described in the foregoing can also be applied to arrangements in which processing means in the form of a cleaning blade or a cleaning roller is to be reciprocated.

As described in the foregoing, in the present invention, a drive receiving portion for reciprocating processing means is adapted to be pivotally movable, and regulating means for regulating its pivotal movement is provided. With these features, it is possible to operate the processing means stably relative to an image bearing member without increasing the load.

What is claimed is:

1. A drive transmission mechanism for transmitting a driving force to process means for performing a process on an image bearing member and being in contact with the image bearing member, comprising:

supporting means for supporting the process means, said supporting means being pivotally movable;

a driving force receiving portion, provided on said supporting means, configured and positioned to receive a driving force for reciprocating the process means in a longitudinal direction of the image bearing member, from a driving force imparting member; and regulating means for regulating pivotal movement of said supporting means, wherein said supporting means includes a pivotal movement shaft portion provided along the longitudinal direction, and wherein said supporting means is pivotally movable with said pivotal movement shaft portion being a pivot around which said supporting means pivots.

2. A drive transmission mechanism according to claim 1, wherein the driving force imparting member is rotatable and provided with a cam portion that transmits the driving force with a rotation of the driving force imparting member.

3. A drive transmission mechanism according to claim 1, wherein the driving force imparting member imparts at said driving force receiving portion a force for pivotally moving said supporting means with said pivotal movement shaft portion being a pivot around which said supporting means pivots when the driving force imparting member imparts the force for pivotally moving said supporting means.

4. A drive transmission mechanism according to claim 3, wherein said regulating means regulates pivotal movement of said supporting means between said pivotal movement shaft portion and said driving force receiving portion.

5. A drive transmission mechanism according to claim 1, wherein said regulating means regulates pivotal movement of said driving force receiving portion.

6. A drive transmission mechanism according to claim 5, wherein said regulating means is provided downstream of said driving force receiving portion with respect to a pivotal movement direction of said supporting means.

7. A drive transmission mechanism according to claim 1, wherein said pivotal movement shaft portion supports said driving force receiving portion, and wherein said supporting means further includes a second shaft portion provided along the longitudinal direction, said second shaft portion supporting said driving force receiving portion with clearance therebetween such that said second shaft portion and said driving force receiving portion are pivotally movable relative to each other around said pivotal movement shaft portion, which is a pivot around which said driving force receiving portion and said second shaft portion are pivotally movable relative to each other.

8. A drive transmission mechanism according to claim 1, wherein the process means includes a first brush in contact with the image bearing member and a second brush in contact with the image bearing member at a position further downstream than the first brush with respect to a rotation direction of the image bearing member.

9. A drive transmission mechanism for transmitting a driving force to a process device configured and positioned to perform a process on an image bearing member and being in contact with the image bearing member, comprising:

a support positioned and configured to support the process device, said support being pivotally movable; and a driving force receiving portion provided on said support and configured and positioned to receive a driving force for reciprocating the process device in a longitudinal direction of the image bearing member, from a driving force imparting member, wherein said support includes:

a pivotal movement shaft portion provided along the longitudinal direction and configured and positioned to support said driving force receiving portion, said support being pivotally movable with said pivotal movement shaft portion being a pivot around which said support pivots; and a second shaft portion provided along the longitudinal direction, said second shaft portion supporting said driving force receiving portion with clearance therebetween such that said second shaft portion and said driving force receiving portion are pivotally movable relative to each other around said pivotal movement shaft portion, which is a pivot around which said driving force receiving portion and said second shaft portion are pivotally movable relative to each other.

10. A drive transmission mechanism according to claim 9, wherein the driving force imparting member is rotatable and is provided with a cam portion that transmits the driving force with a rotation of the driving force imparting member.

11. A drive transmission mechanism according to claim 9, wherein the driving force imparting member imparts a force at said driving force receiving portion for pivotally moving said support with said pivotal movement shaft portion being a pivot around which said support pivots when the driving force imparting member imparts a force for pivotally moving said support.

12. A drive transmission mechanism according to claim 9, wherein said process device includes a first brush in contact with the image bearing member and a second brush in contact with the image bearing member at a position further downstream than said first brush with respect to a rotation direction of the image bearing member.

13. A cartridge detachably attachable to a body of an image forming apparatus, comprising:

process means for performing a process on an image bearing member and being in contact with the image bearing member; and a drive transmission mechanism configured and positioned to transmit a driving force to said process means, said drive transmission mechanism including:

supporting means for supporting said process means, said supporting means being pivotally movable;

a driving force receiving portion provided on said supporting means and configured and positioned to receive a driving force for reciprocating said process means in a longitudinal direction of the image bearing member, from a driving force imparting member; and regulating means for regulating a pivotal movement of said supporting means, wherein said supporting means includes a pivotal movement shaft portion provided along the longitudinal direction, and wherein said supporting means is pivotally movable with said pivotal movement shaft portion being a pivot around which said supporting means pivots.

14. A cartridge according to claim 13, wherein the driving force imparting member is rotatable and is provided with a cam portion that transmits the driving force with a rotation of the driving force imparting member.

15. A cartridge according to claim 13, wherein the driving force imparting member imparts at said driving force receiving portion a force for pivotally moving said supporting means with said pivotal movement shaft portion being a pivot around which said supporting means pivots when the driving force imparting member imparts the force for pivotally moving said supporting means.

16. A cartridge according to claim 15, wherein said regulating means regulates pivotal movement of said supporting means between said pivotal movement shaft portion and said driving force receiving portion.

17. A cartridge according to claim 13, wherein said regulating means regulates pivotal movement of said driving force receiving portion.

18. A cartridge according to claim 17, wherein said regulating means is provided downstream of said driving force receiving portion with respect to a pivotal movement direction of said supporting means.

19. A cartridge according to claim 13, wherein said pivotal movement shaft portion supports said driving force receiving portion, and wherein said supporting means further includes a second shaft portion provided along the longitudinal direction, said second shaft portion supporting said driving force receiving portion with clearance therebetween such that said second shaft portion and said driving force receiving portion are pivotally movable relative to each other around said pivotal movement shaft portion, which is a pivot around which said driving force receiving portion and said second shaft portion are pivotally movable relative to each other.

20. A cartridge according to claim 13, wherein said process means includes a first brush in contact with the image bearing member and a second brush in contact with the image bearing member at a position further downstream than said first brush with respect to a rotation direction of the image bearing member.

21. A cartridge according to claim 13, wherein said process means includes a charge imparting member configured and positioned to impart a charge to residual developer on the image bearing member after an image is transferred from the image bearing member to an image receiving member with developer.

22. A cartridge according to claim 13, wherein said process means includes:

a first charge imparting member configured and positioned to impart, to residual developer on the image bearing member after an image has been transferred from the image bearing member to an image receiving member using developer, a charge of a polarity opposite to a normal charge polarity of the developer; and a second charge imparting member configured and positioned to impart, to the developer to which a charge has been imparted by said first charge imparting member, a charge of the polarity that is the same as the normal charge polarity.

23. A cartridge according to claim 21, wherein the residual developer is recoverable by a developing device configured and positioned to develop an electrostatic image formed on the image bearing member with the developer.

24. A cartridge according to claim 22, wherein the residual developer is recoverable by a developing device configured and positioned to develop an electrostatic image formed on the image bearing member with the developer.

25. A cartridge according to claim 13, wherein said cartridge has a charging member configured and positioned to charge the image bearing member and a cleaning member configured and positioned to clean said charging member, said cleaning member being reciprocated in the longitudinal direction together with said supporting means.

26. A cartridge according to claim 13, wherein said cartridge has the driving force imparting member.

27. A cartridge according to claim 13, wherein said cartridge has the image bearing member.

28. A cartridge according to claim 13, wherein the image bearing member is a photosensitive member.

29. A cartridge detachably attachable to a body of an image forming apparatus, comprising:

a process device that is in contact with an image bearing member to perform a process on the image bearing member; and a drive transmission mechanism configured and positioned to transmit a driving force to said process device, said drive transmission mechanism including:

a support configured and positioned to support said process device, said support being pivotally movable; and a driving force receiving portion provided on said support and configured and positioned to receive a driving force for reciprocating said process device in a longitudinal direction of the image bearing member, from a driving force imparting member, wherein said support includes:

a pivotal movement shaft portion provided along the longitudinal direction and configured and positioned to support said driving force receiving portion, said support being pivotally movable with said pivotal movement shaft portion being a pivot around which said support pivots; and a second shaft portion provided along the longitudinal direction, said second shaft portion supporting said driving force receiving portion with clearance therebetween such that said second shaft portion and said driving force receiving portion are pivotally movable relative to each other around said pivotal movement shaft portion, which is a pivot around which said driving force receiving portion and said second shaft portion are pivotally movable relative to each other.

30. A cartridge according to claim 29, wherein the driving force imparting member is rotatable and is provided with a cam portion that transmits the driving force with a rotation of the driving force imparting member.

31. A cartridge according to claim 29, wherein the driving force imparting member imparts at said driving force receiving portion a force for pivotally moving said support with said pivotal movement shaft portion being a pivot around which said support pivots when the driving force imparting portion imparts the driving force.

32. A cartridge according to claim 29, wherein said process device includes:

a first brush in contact with the image bearing member; and a second brush in contact with the image bearing member at a position further downstream than said first brush with respect to a rotation direction of the image bearing member.

33. A cartridge according to claim 29, wherein said process device includes a charge imparting member configured and positioned to impart a charge to residual developer on the image bearing member after an image is transferred from the image bearing member to an image receiving member using developer.

34. A cartridge according to claim 29, wherein said process device includes:

a first charge imparting member configured and positioned to impart, to residual developer on the image bearing member after an image has been transferred from the image bearing member to an image receiving member using developer, a charge of a polarity opposite to a normal charge polarity of the developer; and a second charge imparting member configured and positioned to impart, to the developer to which a charge has been imparted by said first charge imparting member, a charge of the polarity that is the same as the normal charge polarity.

35. A cartridge according to claim 33, wherein the residual developer is recoverable by a developing device configured and positioned to develop an electrostatic image formed on the image bearing member with the developer.

36. A cartridge according to claim 34, wherein the residual developer is recoverable by a developing device configured and positioned to develop an electrostatic image formed on the image bearing member with the developer.

37. A cartridge according to claim 29, wherein said cartridge has a charging member configured and positioned to charge the image bearing member and a cleaning member configured and positioned to clean said charging member, said cleaning member being reciprocated in the longitudinal direction together with said support.

38. A cartridge according to claim 29, wherein said cartridge has the driving force imparting member.

39. A cartridge according to claim 29, wherein said cartridge has the image bearing member.

40. A cartridge according to claim 29, wherein the image bearing member is a photosensitive member.

41. A drive transmission mechanism for transmitting a driving force to process means for performing a process on an image bearing member and being in contact with the image bearing member, comprising:

supporting means for supporting the process means, said supporting means being pivotally movable;

a driving force receiving portion, provided on said supporting means, configured and positioned to receive a driving force for reciprocating the process means in a longitudinal direction of the image bearing member, from a driving force imparting member; and regulating means for regulating pivotal movement of said supporting means, wherein said regulating means regulates pivotal movement of said driving force receiving portion.

42. A drive transmission mechanism for transmitting a driving force to process means for performing a process on an image bearing member and being in contact with the image bearing member, the process means including a first brush in contact with the image bearing member and a second brush in contact with the image bearing member at a position further downstream than the first brush with respect to a rotation direction of the image bearing member, said drive transmission mechanism comprising:

supporting means for supporting the process means, said supporting means being pivotally movable;

a driving force receiving portion, provided on said supporting means, configured and positioned to receive a driving force for reciprocating the process means in a longitudinal direction of the image bearing member, from a driving force imparting member; and regulating means for regulating pivotal movement of said supporting means.

43. A cartridge detachably attachable to a body of an image forming apparatus, comprising:

process means for performing a process on an image bearing member and being in contact with the image bearing member; and a drive transmission mechanism configured and positioned to transmit a driving force to said process means, said drive transmission mechanism including:

supporting means for supporting said process means, said supporting means being pivotally movable;

a driving force receiving portion provided on said supporting means and configured and positioned to receive a driving force for reciprocating said process means in a longitudinal direction of the image bearing member, from a driving force imparting member; and regulating means for regulating a pivotal movement of said supporting means, wherein said regulating means regulates pivotal movement of said driving force receiving portion.

44. A cartridge detachably attachable to a body of an image forming apparatus, comprising:

process means for performing a process on an image bearing member and being in contact with the image bearing member, wherein said process means includes:

a first brush in contact with the image bearing member; and a second brush in contact with the image bearing member at a position further downstream than said first brush with respect to a rotation direction of the image bearing member; and a drive transmission mechanism configured and positioned to transmit a driving force to said process means, said drive transmission mechanism including:

supporting means for supporting said process means, said supporting means being pivotally movable;

a driving force receiving portion provided on said supporting means and configured and positioned to receive a driving force for reciprocating said process means in a longitudinal direction of the image bearing member, from a driving force imparting member; and regulating means for regulating a pivotal movement of said supporting means.

45. A cartridge detachably attachable to a body of an image forming apparatus, comprising:

process means for performing a process on an image bearing member and being in contact with the image bearing member, wherein said process means includes a charge imparting member configured and positioned to impart a charge to residual developer on the image bearing member after an image is transferred from the image bearing member to an image receiving member with developer; and a drive transmission mechanism configured and positioned to transmit a driving force to said process means, said drive transmission mechanism including:

supporting means for supporting said process means, said supporting means being pivotally movable;

a driving force receiving portion provided on said supporting means and configured and positioned to receive a driving force for reciprocating said process means in a longitudinal direction of the image bearing member, from a driving force imparting member; and regulating means for regulating a pivotal movement of said supporting means.

46. A cartridge detachably attachable to a body of an image forming apparatus, comprising:

process means for performing a process on an image bearing member and being in contact with the image bearing member wherein said process means includes:

a first charge imparting member configured and positioned to impart, to residual developer on the image bearing member after an image has been transferred from the image bearing member to an image receiving member using developer, a charge of a polarity opposite to a normal charge polarity of the developer; and a second charge imparting member configured and positioned to impart, to the developer to which a charge has been imparted by said first charge imparting member, a charge of the polarity that is the same as the normal charge polarity; and a drive transmission mechanism configured and positioned to transmit a driving force to said process means, said drive transmission mechanism including:

supporting means for supporting said process means, said supporting means being pivotally movable;

a driving force receiving portion provided on said supporting means and configured and positioned to receive a driving force for reciprocating said process means in a longitudinal direction of the image bearing member, from a driving force imparting member; and regulating means for regulating a pivotal movement of said supporting means.

* * * * *